US010054082B2

(12) United States Patent
King

(10) Patent No.: US 10,054,082 B2
(45) Date of Patent: Aug. 21, 2018

(54) CARBURETOR WITH FUEL METERING DIAPHRAGM

(71) Applicant: Walbro LLC, Tucson, AZ (US)

(72) Inventor: Eric L. King, Caro, MI (US)

(73) Assignee: WALBRO LLC, Tucson, AZ (US)

( * ) Notice: Subject to any disclaimer, the term of this patent is extended or adjusted under 35 U.S.C. 154(b) by 61 days.

(21) Appl. No.: 15/292,838

(22) Filed: Oct. 13, 2016

(65) Prior Publication Data

US 2017/0107947 A1 Apr. 20, 2017

Related U.S. Application Data

(60) Provisional application No. 62/243,861, filed on Oct. 20, 2015.

(51) Int. Cl.

| | |
|---|---|
| ***B01F 3/04*** | (2006.01) |
| ***F02M 17/00*** | (2006.01) |
| ***F02M 17/04*** | (2006.01) |

(52) U.S. Cl.

CPC ..... *F02M 17/04* (2013.01); *B01F 3/04* (2013.01)

(58) Field of Classification Search

CPC ..... F02M 17/04; B01F 3/04
USPC ..... 261/35, 69.1, DIG. 3
See application file for complete search history.

(56) References Cited

U.S. PATENT DOCUMENTS

| | | | |
|---|---|---|---|
| 2,569,285 | A | 9/1951 | Brown |
| 3,758,093 | A | 9/1973 | Bowditch |
| 3,816,762 | A | 6/1974 | Holt, Jr. |
| 4,125,102 | A | 11/1978 | Tanaka et al. |
| 4,159,012 | A | 6/1979 | Pizzuto et al. |
| 4,271,093 | A | 6/1981 | Kobayashi |
| RE32,880 | E | 2/1989 | Lapeyre |
| 4,978,478 | A | 12/1990 | Vonderau et al. |
| 5,262,092 | A | 11/1993 | Reeder et al. |
| 6,000,369 | A | 12/1999 | Koizumi |
| 6,017,199 | A | 1/2000 | Yanaka |
| 6,135,429 | A | 10/2000 | Woody |
| 6,340,294 | B1 | 1/2002 | Kubota |
| 6,581,916 | B1 | 6/2003 | Shaw |
| 6,698,727 | B1 | 3/2004 | Shaw |
| 6,702,261 | B1 | 3/2004 | Shaw |
| 7,658,170 | B2 | 2/2010 | Wada et al. |
| 2002/0195726 | A1 | 12/2002 | Galka et al. |
| 2003/0015808 | A1 | 1/2003 | Burns et al. |

(Continued)

FOREIGN PATENT DOCUMENTS

| | | | |
|---|---|---|---|
| EP | 1116873 | A2 | 7/2001 |
| JP | S49102215 | A | 9/1974 |

(Continued)

*Primary Examiner* — Robert A Hopkins
(74) *Attorney, Agent, or Firm* — Reising Ethington P.C.

(57) ABSTRACT

A carburetor with a fuel and air mixing passage and a fuel delivery system may include a valve actuated by a diaphragm with no penetrations through at least the portion of the diaphragm exposed to a fuel metering chamber. The diaphragm may include at least two convolutions increasing a surface area of the portion of the diaphragm exposed to the fuel metering chamber relative to the surface area of a plane exposed to and covering the fuel metering chamber. A diaphragm may be in the form of a bellows with at least two convolutions. The diaphragm may be made of a suitable polymer or one or more pieces of a thin metal sheet or foil.

22 Claims, 4 Drawing Sheets

(56) References Cited

U.S. PATENT DOCUMENTS

| | | | | |
|---|---|---|---|---|
| 2003/0047818 | A1* | 3/2003 | Nagata | F02M 17/04<br>261/35 |
| 2008/0203344 | A1 | 8/2008 | Cobb | |
| 2011/0067677 | A1 | 3/2011 | Herzer | |

FOREIGN PATENT DOCUMENTS

| | | | |
|---|---|---|---|
| JP | S5129156 | U | 3/1976 |
| JP | S54141229 | U | 10/1979 |
| JP | 2007239463 | A | 9/2007 |
| WO | WO2007054056 | A1 | 5/2007 |
| WO | WO2008046719 | A1 | 4/2008 |

* cited by examiner

CARBURETOR WITH FUEL METERING DIAPHRAGM

REFERENCE TO RELATED APPLICATIONS

This application claims the benefit of U.S. Provisional Patent Application Ser. No. 62/243,861, filed on Oct. 20, 2015, which is incorporated herein by reference in its entirety.

TECHNICAL FIELD

The present disclosure relates generally to carburetors for use with internal combustion engines and, more specifically, to a carburetor with a fuel metering diaphragm.

BACKGROUND

Carburetors are devices that can be used to mix fuel and air to power combustion engines typically including gasoline powered internal combustion spark ignited engines. A carburetor may include a fuel metering system that helps to control the amount of fuel supplied to air flowing through a mixing passage or main bore of the carburetor for mixing the fuel with air and supplying the mixture to the engine. Some metering systems employ a diaphragm that oscillates or reciprocates during operation to open and close a metering valve admitting fuel to a chamber from which it is supplied to the passage for mixing with air. In use, the large number of cycles experienced by such a diaphragm which typically physically interacts with other components of the metering system such as a valve actuating lever, and continuous exposure to solvent containing fuels, can result in a harsh operating environment that causes wear, degradation and ultimately failure of the diaphragm. In a gasoline powered spark ignited internal combustion so-called small engine the diaphragm must fully open the valve when subjected to only a small pressure differential which is typically a maximum negative pressure of −0.9956 kPa or −0.1444 pounds per square inch and usually about −0.50 kPa or −0.0725 pounds per square inch (psi). This very small differential operating pressure also requires that the portion of the diaphragm within a fuel metering chamber be very flexible particularly since such diaphragm may have a surface area within the metering chamber in the range of about 0.5 square inch to 1.0 square inch.

SUMMARY

A carburetor with a main bore or fuel and air mixing passage through a body may include a diaphragm defining part of a fuel metering chamber and movable to actuate the valve and with a flexible portion open to the fuel metering chamber and without a perforation through at least the portion of the diaphragm exposed to the fuel metering chamber. A diaphragm may include at least two convolutions providing an increased surface area within the fuel metering chamber compared to the surface area of a plane exposed to and covering the fuel metering chamber. The convolutions may increase the surface area by at least 20% and the diaphragm may be in the form of a bellows with at least two convolutions. The diaphragm may be made of one or more flexible sheets or foils of metal. The diaphragm may also be made in one piece of a flexible elastomer resistant to degradation and swelling when in continuous contact with liquid fuels.

BRIEF DESCRIPTION OF THE DRAWINGS

The following detailed description of certain embodiments and best mode will be set forth with reference to the accompanying drawings, in which.

DETAILED DESCRIPTION

Figure 1:
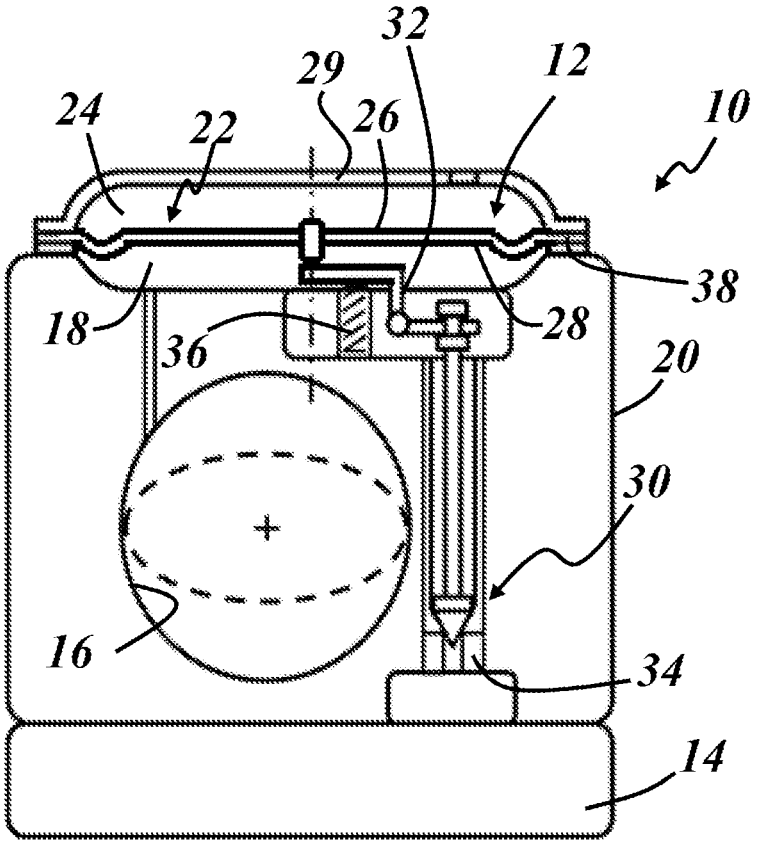
FIG. 1 is a schematic cross-sectional view of a carburetor including a diaphragm type metering assembly.

Referring in more detail to the drawings, FIG. 1 is a schematic cross-sectional view of a carburetor 10 having a diaphragm-type fuel metering system 12, according to one embodiment. Generally, the fuel metering system is a system configured to deliver fuel from a fuel source 14 to a main bore 16 (sometimes called a fuel and air mixing passage) via various channels, conduits, and/or chambers, one of which is a fuel metering chamber 18. In this non-limiting example the fuel source is an on-board fuel pump, which may include a diaphragm style pump. The main bore 16 is formed through a main body 20 of the carburetor to facilitate air flow from the environment to an engine and to mix fuel with the air as it passes therethrough. The metering system 12 includes a fuel metering diaphragm 22 that defines part of a reference chamber 24 on a reference side 26 of the diaphragm 22 which may also be defined in part by a portion of the carburetor body, shown in FIG. 1 as including a cover 29 coupled to the main body 20 as will be set forth in more detail below. The diaphragm 22 also defines part of the fuel metering chamber 18 on a chamber side 28 of the diaphragm 22 opposite to the reference side 26 and facing the main body 20. The diaphragm 22 moves (e.g. flexes in one direction or the other) in response to a differential pressure within the chambers 18, 24 and across the diaphragm 22 to actuate a metering valve 30 either directly or via one or more other metering system components.

In operation, a demand for fuel at the engine increases air flow through the main bore 16, thus reducing fluid pressure in the metering chamber 18 and at the chamber side 28 of the diaphragm 22. A reference pressure in the reference chamber 24, such as atmospheric pressure, acting on the reference side 26 of the diaphragm 22, moves a portion of the diaphragm 22 toward the main body 20 in a direction that reduces the volume of the metering chamber 18 as fuel is delivered to the main bore 16. In at least some implementations, the diaphragm 22 engages a lever 32 that is coupled to the metering valve 30 and opens the metering valve 30 to allow fuel to flow from the fuel source 14 into the metering chamber 18 to replace the fuel delivered from the metering chamber 18 to the main bore 16. This increases the fluid pressure in the metering chamber 18, reversing the direction of movement of the diaphragm away from the carburetor main body 20 in a direction that increases the volume of the metering chamber 18. This diaphragm movement eliminates or reduces the force on the lever 32 so that the metering valve 30 may close against a valve seat 34, such as under the biasing force of a spring 36 acting on the lever 32 to yieldably bias the metering valve to its closed position. The valve closure causes the metering chamber pressure to decrease and begin a new metering cycle as long as there is a demand for fuel at the engine. The carburetor of FIG. 1 is illustrative in nature, the teachings presented herein may be applied to any type of carburetor and with various diaphragm metering system configurations.

Figure 2:
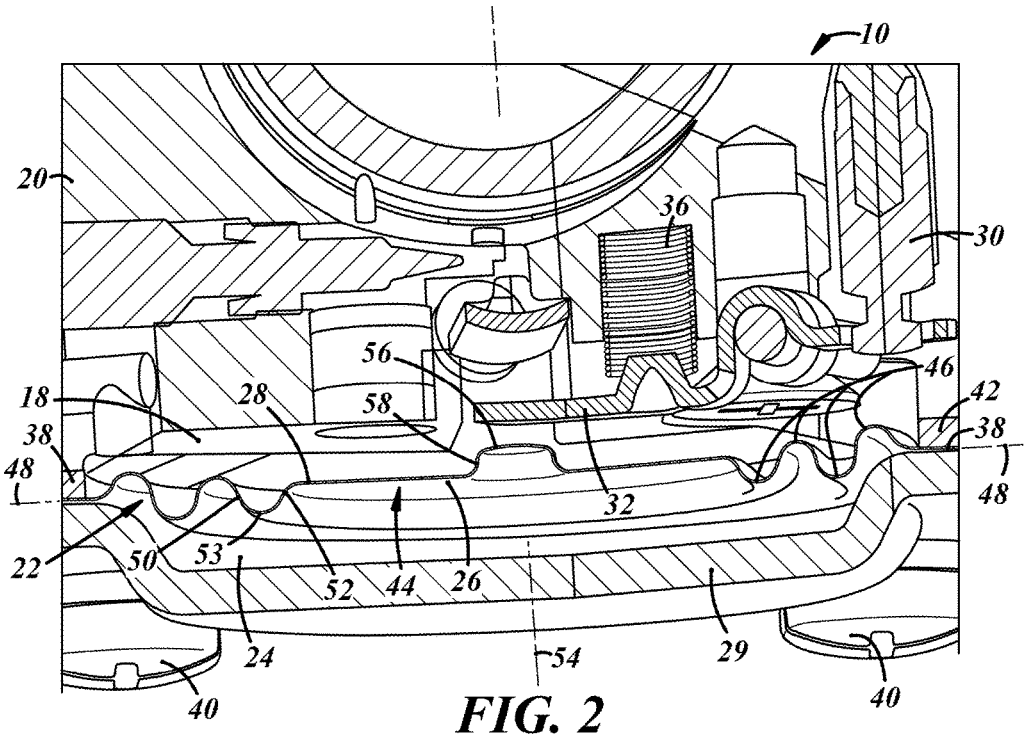
FIG. 2 is a fragmentary cross-sectional view of a carburetor showing a fuel metering assembly of the carburetor.

Referring to FIG. 2, a portion of the carburetor 10 including the diaphragm 22 and part of the lever 32 and metering valve 30 are shown in more detail. The diaphragm 22 has a periphery 38 that is trapped between the cover 29 and main body 20, such as when the cover 29 is coupled to the main body 20 by one or more screws 40. A gasket 42 may be provided between the diaphragm 22 and the main body 20 to improve or provide a fluid-tight seal for the metering chamber 18. Hence, a central portion 44 of the diaphragm 22, which is spaced inwardly from the trapped periphery 38 of the diaphragm, divides the space between the cover 29 and main body 20 into the fuel metering chamber 18 and the reference chamber 24. To be responsive to the pressures within the chambers 18, 24, the central portion 44 of the diaphragm 22 is flexible so that the diaphragm 22 may flex from an at rest position (shown in FIG. 2) toward the main body 20 to actuate the metering valve 30 (e.g. engage and pivot lever 32) and to flex away from the main body 20 or return to the at rest or not flexed position. The central portion 44 of the diaphragm is exposed within the chambers 18 and 24, and may be referred to herein as the "exposed portion" 44.

In this implementation, the diaphragm 22 is formed from metal and includes more than one convolution 46. Inclusion of at least one convolution 46 makes the surface area of the exposed portion 44 of the flexible diaphragm 22 larger than a projected area of the exposed portion (e.g. large than the portion of an imaginary plane 48 extending between the cover 29 and main body 20 and exposed to the chambers 18, 24). The convolutions 46 increase the flexibility of the diaphragm and increase the range of movement of the diaphragm 22. The larger the convolution(s) 46 (i.e., the greater the surface area of the convolutions), the greater the overall allowable diaphragm movement is.

In at least some implementations, each convolution 46 is defined by curved, bent or otherwise nonlinear portions of the diaphragm 22, that define generally concave or convex sections of the diaphragm. Each convolution 46 may include first and second sections 50, 52 of the diaphragm on opposite sides of and leading to a bend or bight 53. The convolutions 46 thus form concave or convex portions of the diaphragm 22, and the convolutions may be circumferentially complete and oriented about an axis 54 of the diaphragm 22 such that the concave or convex portions are annular. In at least some implementations, multiple convolutions 46 may be provided with both concave and convex convolutions oriented or facing generally axially (e.g. the first and second sections 50, 52—or a centerline between them—may be oriented generally parallel to the axis 54 of the diaphragm, plus or minus forty-five degrees).

In the implementation shown in FIG. 2, four convolutions 46 are shown, and the convolutions 46 are adjacent to each other so that a second section 52 of one convolution defines a first section 50 of an adjacent convolution. Further, two concave and two convex convolutions 46 are provided, and they alternate so that, for example, when moving from the periphery 38 toward the center of the diaphragm (i.e. axis 54), the convolutions 46 are convex, concave, convex and concave, and together are shaped like two sine waves. Still further, the exposed portion 44 of the diaphragm 22 may extend generally along the plane 48 and the convolutions 46 may, in at least some implementations, extend both above and below the level of the plane 48, as viewed from the metering chamber 18. In the implementation shown, the convolutions 46 are centered about the plane 48, in other words, they extend as much above the plane as below the plane, although they need not be so arranged. The diaphragm 22 may be formed by stamping or other desired forming process, and the convolutions 46 may be formed at the same time that the diaphragm 22 is cut from a roll of material (the diaphragm may be cut from the roll and stamped to shape in the same process, in the same die or in separate dies). At least the exposed portion 44 of the diaphragm 22 may be imperforate, without any openings or other penetrations therethrough.

A contact portion 56 of diaphragm 22 makes physical contact with other metering system components to actuate the metering valve 30. In the illustrated embodiment, contact portion 56 is part of a boss or raised portion 58 of the diaphragm 22 aligned with an end of the lever 32 and arranged to actuate the lever. The contact portion 56 may be formed in the same piece of material as the remainder of the diaphragm 22, providing a diaphragm 22 with convolutions 46 and a contact portion 56 that are all defined in the same continuous piece of material. In the example shown, the convolutions 46 are defined in a radially outermost area of the exposed portion 44 adjacent to the diaphragm periphery 38 trapped between the cover 29 and body 20, and the contact portion 56 is located radially inwardly spaced from the convolutions 46. Hence, the convolutions 46 are provided where the diaphragm 22 is stiffest (adjacent to the point of connection to the carburetor) to increase the responsiveness and range of motion of the diaphragm 22.

Figure 3:
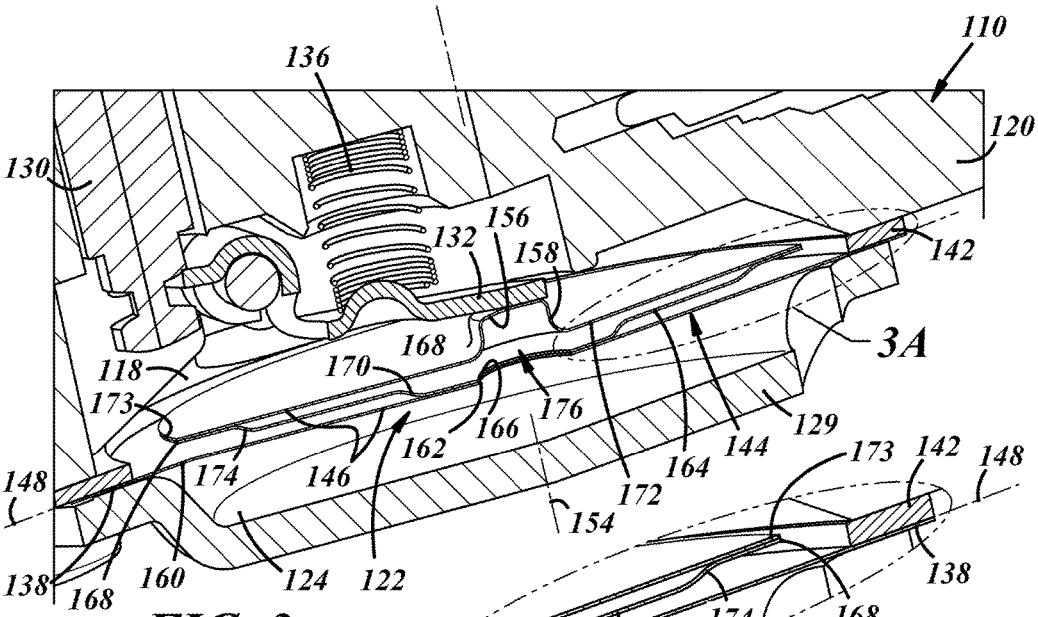
FIG. 3 is a fragmentary cross-sectional view of a carburetor showing a fuel metering assembly of the carburetor.
Figure 3A:
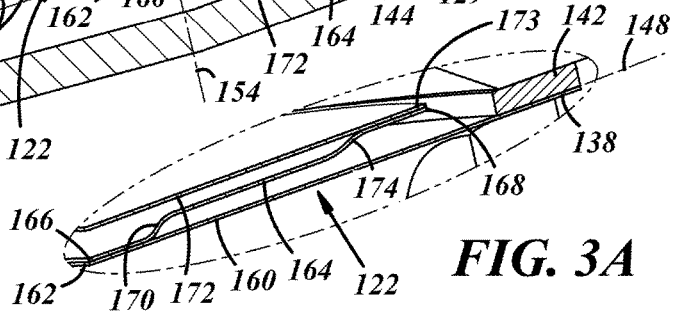
FIG. 3A is an enlarged view of the portion of FIG. 3 in the oval 3A.

An alternate diaphragm 122 is shown in FIGS. 3 and 3A, and may be used in a carburetor 110 like carburetor 10. For ease of description, features of diaphragm 122 and carburetor 110 that are similar to features of diaphragm 22 and carburetor 10 will be given references numerals increased by 100 from those used for diaphragm 22 and carburetor 10. This diaphragm 122 may include more than one piece of material joined together to act as a one-piece diaphragm. This diaphragm 122 also has at least two convolutions 146 to increase the flexibility and range of motion of the diaphragm 122 when exposed to the normal range of pressure differentials experienced in use of the carburetor 110. And this diaphragm 122 may be free of penetrations or other through openings extending through the diaphragm, at least within a central or exposed portion of the diaphragm 144.

In this implementation, a first piece 160 of the diaphragm 122 may be trapped about its periphery 138 between the cover 129 and main body 120, as described above with regard to diaphragm 22 and carburetor 10. The first piece 160 may be annular, include the trapped periphery 138 and extend radially inwardly to an inner edge 162. A second piece 164 of the diaphragm 122 may be coupled to the first piece 160 at a location radially inwardly of the periphery 138 of the first piece 160. In this example, the second piece 164 is also annular and includes an inner edge 166, that is joined at or adjacent to the inner edge 162 of the first piece 160, and extends radially outwardly to an outer edge 168. The second piece 164 is smaller (has smaller outer diameter) than the first piece 160 and the outer edge 168 of the second piece 164 is radially spaced from the cover 129 or main body 120 and arranged within the space between them. The second piece 164 may include a bent or inclined portion 170 near the inner edge 166 so that a main portion of the second piece 164 is axially spaced from the first piece 160, at least in an at rest position as shown in FIG. 3 (i.e. without a force acting on the diaphragm 122 and tending cause the second piece 164 to further engage the first piece 160). A third piece 172 of the diaphragm 122 may be coupled to the second piece 164, such as at or adjacent to an outer edge 173 of the third piece 172 which may be arranged at or adjacent to the outer edge 168 of the second piece 164. A bent or inclined portion 174 may be provided in one or both the second and third pieces 164,172 (shown as being formed in the second piece 164 radially inwardly spaced from its outer edge 168) so that at least a majority of the third piece 72 is axially spaced from the second piece 164. The third piece 172 may be solid, that is, not annular, so that it does not include any opening or penetration therethrough. The third piece 172 may include a contact portion 156 (which may or might not be defined on a boss 158 or other non-planar portion of the third piece 172) arranged to engage the lever 132 and control the opening and closing of the metering valve 130 as described above. In the example shown, the third piece 172 has an outer diameter that is coextensive with the outer diameter of the second piece 164 and these pieces are welded or otherwise sealed together about their peripheries, as shown in FIGS. 3 and 3A.

When so arranged, the third piece 172 radially overlies the inner edges 162, 166 of the first and second pieces 160, 164. With the second piece 164 also welded or otherwise sealed to the first piece 160, the diaphragm 122 is without any openings or penetrations that extend through it (e.g. from the reference chamber 124 to the metering chamber 118), at least within the portion of the diaphragm 122 not trapped between the cover 129 and main body 120. Further, the connection between the three diaphragm pieces 160, 166, 172 provides two convolutions 146 which are shown as being oriented radially relative to the axis 154 of the diaphragm 122. A first convolution 146, defined between the first and second pieces 160, 164, faces radially outwardly (is convex relative to the axis 154). A second convolution 146, defined between the second and third pieces 164, 172, faces radially inwardly (is concave relative to the axis 154). Like the first and second sections 50, 52 in diaphragm 22, bends or inclined portions on either side of the points of connection between the pieces 160, 164, 172 of diaphragm 122 define the convolutions. In diaphragm 122, at least a majority of the second piece 164 may extend generally parallel to the first piece 160 plus or minus forty-five degrees, and at least a majority of the third piece 172 may extend generally parallel to a majority of the second piece 164 plus or minus forty-five degrees. This provides an accordion type or pleated construction of the diaphragm 122 that permits axial movement or flexing of the diaphragm in response to a pressure differential across the diaphragm.

The pieces 160, 164, 172 may be formed from the same material, or different materials as desired. In one example, each piece is formed from the same type of metal, such as a stainless steel. Further, the diaphragm pieces 160, 164, 172 may be sealed together in any desired manner, such as by laser welding, an adhesive, solder, or the like. While three diaphragm pieces are shown defining two convolutions 146, the diaphragm 122 may be formed from more than three pieces and more than two convolutions may be provided. Further, the diaphragm material is preferably stiff enough to prevent the pieces 160, 164, 172 from collapsing onto themselves under their own weight, so that they remain separate, such as is shown in FIG. 3, at least until acted upon by sufficient force. Further, the material is resilient enough to return the diaphragm 122 to the position shown in FIG. 3 in use, when there is no pressure differential acting on the diaphragm 122.

In this example, the radial overlap provided by the interconnected diaphragm pieces significantly increases the surface area of the exposed portion 144 of the diaphragm 122, which is exposed to the pressure within the metering chamber 118 and the reference chamber 124. The first and second pieces 160, 164 define a cavity 176 at their inner edges 162, 166 and the boss defining the contact portion 156 extends away from the cavity 176. The cavity 176 is exposed to the pressure within the reference chamber 124, as is the exposed portion (i.e. the effective area) of the first piece 160, which is the portion of the first piece 160 that is not overlapped by the cover 129 and main body 120 and extending to the inner edge 162. Likewise, the pressure within the metering chamber 118 acts on the combined surface area of the third piece 172 and the portion of the first piece 160 exposed to the metering chamber 118. In at least some implementations, the effective surface area of the exposed portion 144 of the diaphragm 122 may be about 20% or more greater than the surface area of a plane 148 exposed to the chambers 118, 124 and extending between the cover 129 and main body 120. Thus, the forces on the diaphragm 122 may be greater than if the diaphragm 122 were planar or essentially planar, and the diaphragm 122 may be more responsive to pressures acting on it. That is, the diaphragm 122 may be flexed or moved at a lower differential pressure, and it may move or flex more under a pressure differential of a given magnitude. In at least some implementations, the second piece 164 radially overlaps at least 50% of the first piece 160, and has a surface area that is 40% to 90% as large as the exposed area of the plane 148.

Figure 4:
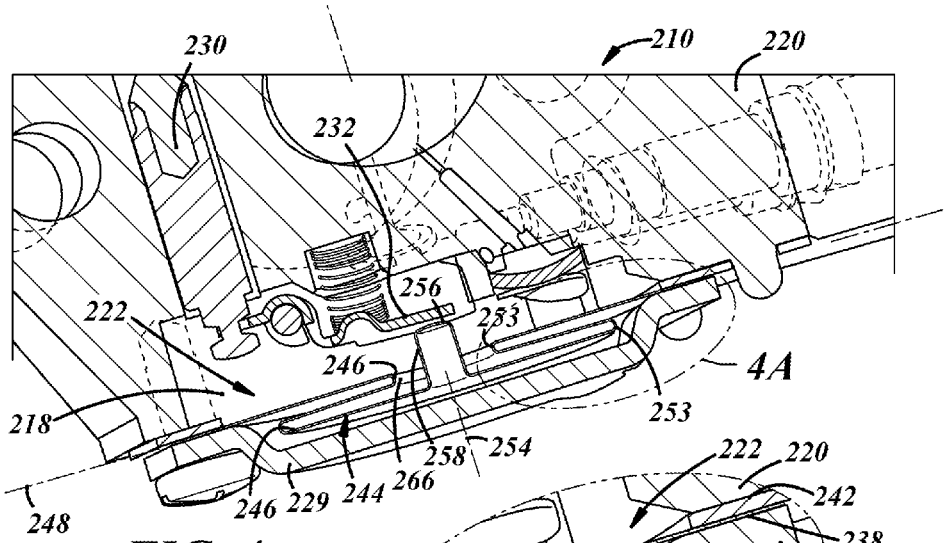
FIG. 4 is a fragmentary cross-sectional view of a carburetor showing a fuel metering assembly of the carburetor.
Figure 4A:
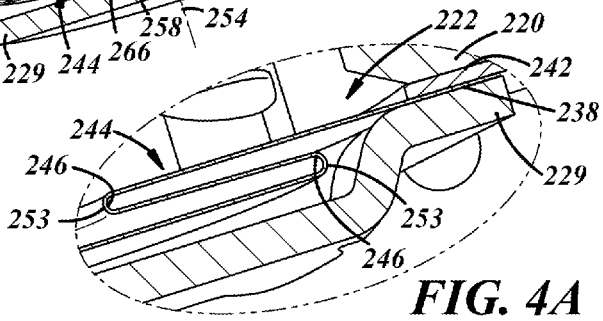
FIG. 4A is an enlarged view of the portion of FIG. 4 in the oval 4A.

FIGS. 4 and 4A show a one-piece diaphragm 222 that may be used in a carburetor 210 like carburetor 10. For ease of description, features of diaphragm 222 and carburetor 210 that are similar to features of diaphragm 22 and carburetor 10 will be given references numerals increased by 200 from those used for diaphragm 22 and carburetor 10. The diaphragm 222 may have a similar shape as the diaphragm 122, including an accordion folded or somewhat pleated shape. This diaphragm 222 is formed from a single piece of material, and may be provided without any through openings or penetrations, at least within the exposed portion 244 of the diaphragm 222 (not trapped between the cover 229 and main body 220). The diaphragm 222 may include at least two convolutions 246 each defined by bends or inclined portions of the diaphragm 222 to form generally concave or convex portions of the diaphragm 222. In this example, starting from the periphery 238 of diaphragm 222 and moving inwardly, the first convolution 246 leads to the second convolution 246 which in turn leads to a central or contact portion 256 of the diaphragm. The first convolution 246 faces radially outwardly and the second convolution 246 faces radially inwardly (relative to axis 254). The first and second convolutions 246 may be defined by spaced apart portions of the diaphragm 222 that are joined at a bend or bight 253 and may extend generally parallel to each other (plus or minus forty-five degrees). The contact portion 256 may but might not be defined by a boss 258 or other non-planar portion of the diaphragm. In the example shown, the convolutions 246 are annular and an opening 266 is defined inwardly of at least one convolution 246. In the example shown, the opening 266 is defined by the first convolution 246, and the boss 258 extends toward, and in some implementations, through the opening 266, toward the main body 220 to engage the lever 232. The convolutions 246 may extend radially between 40% to 90% of a plane 248 extending perpendicular to the axis 254 and exposed within the space between the cover 229 and main body 220. This provides a greater surface area of the exposed portion 244 of the diaphragm 222 that is acted upon by the pressures within the chambers 218, 224.

Figure 5:
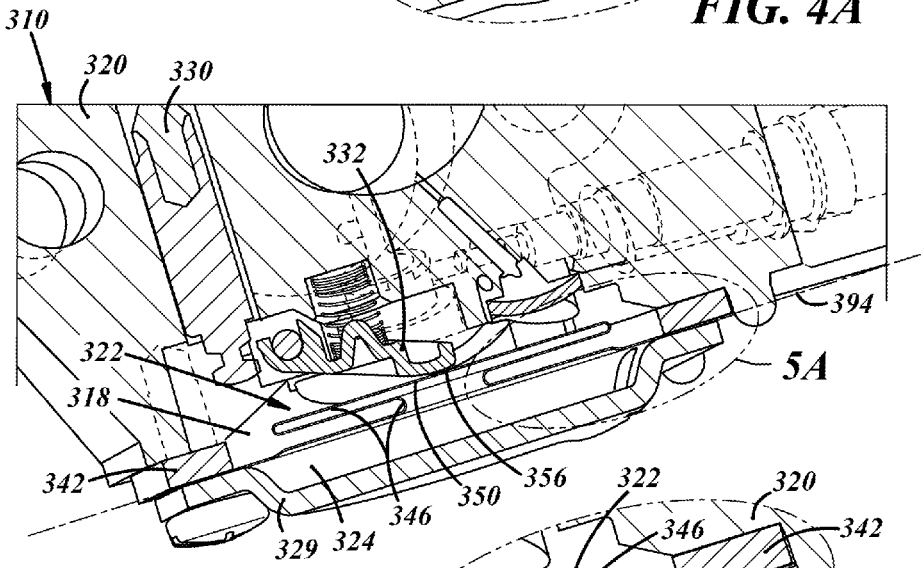
FIG. 5 is a fragmentary cross-sectional view of a carburetor showing a fuel metering assembly of the carburetor.
Figure 5A:
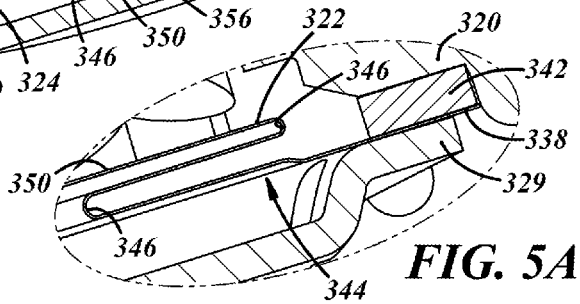
FIG. 5A is an enlarged view of the portion of FIG. 5 in the oval 5A.

Another diaphragm 322 is shown in FIGS. 5 and 5A and may be used in a carburetor 310 like carburetor 10. For ease of description, features of diaphragm 322 and carburetor 310 that are similar to features of diaphragm 22 and carburetor 10 will be given references numerals increased by 300 from those used for diaphragm 22 and carburetor 10. Diaphragm 322 may be formed from a single piece of material, if desired, and may be trapped about its periphery 338 between the body 320 and cover 329. Diaphragm 322 includes two radially oriented convolutions 346, similar to the diaphragm 222 shown in FIG. 4. In this implementation, following along the diaphragm 322 from the periphery 338 and moving inwardly, a first convolution 346 faces radially outwardly and is located axially farther from the metering chamber 318 than is a second convolution 346 that faces radially inwardly and leads to a central portion 350 of the diaphragm 322. The central portion 350 of the diaphragm 322 may include a contact portion 356 to engage the lever 332, as described above. With the central portion 350 located as the portion of the diaphragm axially nearest to the lever 332, the contact portion 356 may be planar or not raised relative to the remainder of the central portion 350. Of course, the contact portion 356 could be defined by a raised or other non-planar portion of the central portion, if desired.

Figure 6:
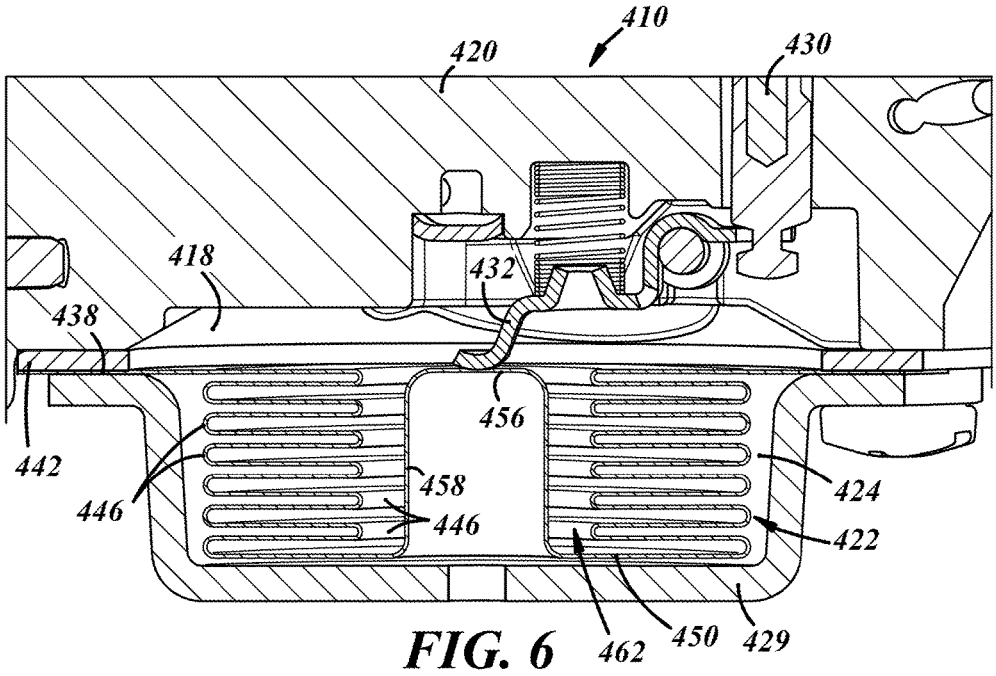
FIG. 6 is a fragmentary cross-sectional view of a carburetor showing a fuel metering assembly of the carburetor.
Figure 7:
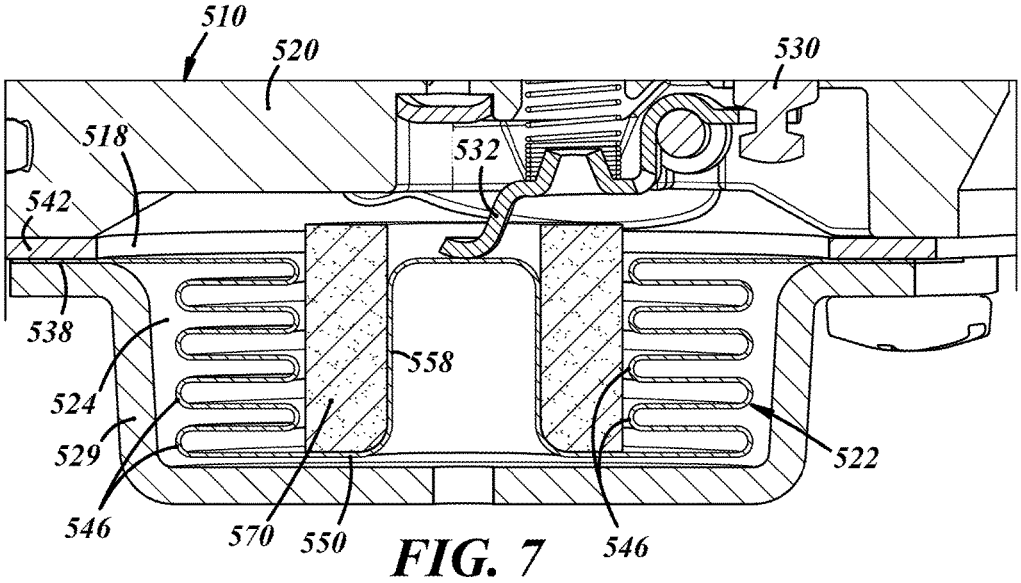
FIG. 7 is a fragmentary cross-sectional view of a carburetor showing a fuel metering assembly of the carburetor.

The diaphragms 422 and 522 shown in FIGS. 6 and 7 are constructed similarly to the diaphragm 222 shown in FIG. 4. The diaphragm 422 shown in FIG. 6 has twelve convolutions 446 instead of two 246 as in the diaphragm 222 of FIG. 4, although any number of convolutions 446 may be provided. The convolutions 446 in diaphragm 422 alternate between radially inwardly facing and radially outwardly facing, in an accordion like or pleated manner. A central portion 450 is axially farther from the metering chamber 418 than the periphery 438 of the diaphragm 422. A contact portion 456 is defined in the central portion 450, and is shown as being defined on a boss 458 that extends axially toward the lever 432 and is located radially inwardly from the portion of the diaphragm 422 including the convolutions 446. The convolutions are shown as annular with an opening 462 defined between them. In this implementation, the boss extends at least partially through the opening 462 toward the lever 432.

The diaphragm 522 shown in FIG. 7 includes eight convolutions 546 (of course, more or fewer may be provided), a boss 558 radially inwardly spaced from the convolutions 546 and extending axially toward the lever 532 from a central portion 550 located axially farther from the metering chamber 518 than the periphery 538 of the diaphragm 522. An insert 570 is located within a cavity 572 defined radially between the boss 558 and the convolutions 546 and in the implementation shown is generally cylindrical. The insert 570 may be formed from any desired material and may be provided to reduce the volume of the metering chamber 518 to improve fuel flow into and out of the metering chamber 518, and/or to dampen movement of the diaphragm 522 due to the convolutions 546. In at least one form, the insert 570 may be formed from a low density foam, which may be formed of a material compatible for use in the fuel flowing through the carburetor (e.g. without swelling in a manner that negatively impacts diaphragm function, without fouling the fuel, etc). Other materials may be used as desired.

In at least some implementations, the diaphragms shown may all be formed of metal. The metal may be inert to the fuel flowing in the carburetor, or otherwise suitable for use in the fuel. One benefit to this is that the metal material will not swell or crack like some polymeric or composite materials used for diaphragms. The metal material may be relatively thin so that it is flexible under the pressures experienced in use of a carburetor, but strong enough to maintain the convolutions and provide relatively controlled diaphragm movement for repeatable and reliable actuation of the metering valve. The diaphragms may be formed from a metal sheet or foil between 0.1000 mm and 0.0127 mm thick. Representative materials include plastic, stainless steel, nickel, copper, aluminum, titanium, cobalt, cobalt-nickel, alloys thereof, and elastomers such as polyacetal, polyester, polyetheretherketone (PEEK), nylon, UHMW polyethylene. Further, the diaphragm may be formed by any suitable process, such as by stamping, electroforming or hydroforming.

In addition to being suitable for use in various fuels, the metal diaphragms are less sensitive to temperature changes in operation (e.g. retain their flexibility over wider range of temperatures) and dissipate heat more quickly compared to diaphragms made from rubber, polymers or composite materials. The heat conduction properties of metal can also be utilized to warm fuel in the metering chamber facilitate cold engine operation, such as by coupling a heating element or heat source with the diaphragm. Further, the metal diaphragms do not need backing plates commonly used with rubber, polymeric or composite diaphragms for rigidity in the area of the metering valve lever, and/or to prevent abrasion of the diaphragm material by the lever. The backing plates are commonly secured with rivets received within a through hole formed in the diaphragm, which provides a potential leak path. Further, the backing plates (usually including washers) and the rivet add complexity and cost associated with multiple parts, including increased difficulty in handling and assembly, and also issues of tolerance control as each component has its own tolerance variations that contribute to a larger overall assembly tolerance (often referred to as tolerance stack-up). Accordingly, the thin, metal diaphragms which need not include backing plates and related components, can be more dimensionally consistent across a production run of diaphragms and a production run of carburetors.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A carburetor, comprising:

a body with a main bore;

a fuel metering assembly from which fuel is delivered into the main bore, the fuel metering assembly including a valve and a diaphragm that defines part of a fuel metering chamber and has a portion movable relative to the body to actuate the valve, and the diaphragm has a flexible exposed portion open to the fuel metering chamber and is formed without any penetrations through the exposed portion.

2. The carburetor of claim 1 wherein the diaphragm has at least two convolutions.

3. The carburetor of claim 1 wherein the diaphragm is formed from a single, continuous piece of metal.

4. The carburetor of claim 3 wherein the diaphragm has at least two convolutions.

5. The carburetor of claim 1 wherein the diaphragm is formed from multiple pieces of metal joined together in a fluid tight manner.

6. The carburetor of claim 5 wherein the pieces of metal are welded together.

7. The carburetor of claim 5 wherein the diaphragm has at least two convolutions.

8. The carburetor of claim 1 wherein the diaphragm comprises at least one of stainless steel, nickel, copper, aluminum, cobalt, cobalt-nickel, or alloys thereof.

9. The carburetor of claim 1 wherein the diaphragm comprises polyacetal, polyester, polyetheretherketone (PEEK), nylon or UHMW polyethylene.

10. The carburetor of claim 1 wherein the diaphragm comprises at least three concentric convolutions which are alternating convex and concave convolutions disposed from adjacent the perimeter of the fuel metering chamber toward the center of the diaphragm within the fuel metering chamber.

11. The carburetor of claim 1 wherein the diaphragm comprises at least two convolutions arranged in a bellows configuration with interconnecting portions generally parallel to each other within plus or minus 45°.

12. The carburetor of claim 1 wherein the diaphragm also comprises a boss providing a contact portion engagable with a lever to actuate the valve, wherein the boss is formed in one piece with the remainder of the diaphragm and is not a separate component coupled to the diaphragm.

13. A carburetor, comprising:

a body with a main bore;

a fuel metering assembly from which fuel is delivered into the main bore, the fuel metering assembly including a valve and a diaphragm that defines part of a fuel metering chamber and has a portion movable relative to the body to actuate the valve; and the diaphragm has a flexible exposed portion open to the fuel metering chamber, having at least two convolutions disposed from adjacent a perimeter of the fuel metering chamber toward the center of the diaphragm within the fuel metering chamber and increasing an exposed surface area of the diaphragm within the fuel metering chamber by at least 20% greater than the surface area of a plane exposed to and covering the fuel metering chamber, and has no penetrations through the exposed portion.

14. The carburetor of claim 13 wherein the diaphragm comprises at least one of stainless steel, nickel, copper, aluminum, cobalt, cobalt-nickel, or alloys thereof.

15. The carburetor of claim 14 wherein at least the portion of the diaphragm within the perimeter of the fuel metering chamber has a thickness in the range of 0.0127 mm to 0.10 mm.

16. The carburetor of claim 13 wherein the diaphragm comprises polyacetal, polyester, polyetheretherketone (PEEK), nylon or UHMW polyethylene.

17. The carburetor of claim 13 wherein the diaphragm comprises at least three concentric convolutions which are alternating convex and concave convolutions disposed from adjacent the perimeter of the fuel metering chamber toward the center of the diaphragm within the fuel metering chamber.

18. The carburetor of claim 13 wherein the diaphragm has a central axis and comprises at least two convolutions, wherein the convolutions face radially relative to the axis.

19. The carburetor of claim 13 wherein the diaphragm also comprises a boss providing a contact portion engagable with a lever to actuate the valve and the contact portion is formed in the same piece of material as the remainder of the diaphragm.

20. A diaphragm for a carburetor, comprising:

a body formed from metal and having at least two convolutions, the body having a perimeter adapted to be mounted to a carburetor body and an exposed portion within the perimeter that is free of penetrations and in which the convolutions are located.

21. The carburetor of claim 2 wherein the diaphragm has a central axis and the convolutions face radially relative to the axis.

22. The carburetor of claim 21 wherein at least one convolution faces radially outwardly and at least one convolution faces radially inwardly.

* * * * *